United States Patent [19]

Reich

[11] Patent Number: 4,669,800

[45] Date of Patent: Jun. 2, 1987

[54] CONNECTOR DEVICE FOR A GROUP OF INSULATED CONDUCTORS

[75] Inventor: Reinhold Reich, Schäftlarn, Fed. Rep. of Germany

[73] Assignee: Siemens Aktiengesellschaft, Berlin and Munich, Fed. Rep. of Germany

[21] Appl. No.: 747,503

[22] Filed: Jun. 21, 1985

[30] Foreign Application Priority Data

Aug. 13, 1984 [DE] Fed. Rep. of Germany ... 8424021[U]

[51] Int. Cl.[4] ..... H01R 4/24

[52] U.S. Cl. ..... 439/399

[58] Field of Search ..... 339/97 R, 97 P, 98, 339/99 R

[56] References Cited

U.S. PATENT DOCUMENTS

| | | | |
|---|---|---|---|
| 2,809,365 | 10/1957 | Broske | 339/276 |
| 3,699,498 | 10/1972 | Hardesty et al. | 339/64 M |
| 3,860,316 | 1/1975 | Hardesty | 339/91 R |
| 3,930,708 | 1/1976 | Wedekind et al. | 339/99 R |
| 4,066,316 | 1/1978 | Rollings | 339/91 R |
| 4,084,878 | 4/1978 | Waki | 339/99 R |
| 4,270,831 | 6/1981 | Takahashi | 339/99 R |
| 4,441,779 | 4/1984 | Foederer et al. | 339/99 R |
| 4,533,198 | 8/1985 | Anhalt | 339/99 R |

FOREIGN PATENT DOCUMENTS

| | | |
|---|---|---|
| 0003650 | 1/1979 | European Pat. Off. . |
| 0063457 | 4/1982 | European Pat. Off. . |
| 2726226 | 12/1978 | Fed. Rep. of Germany . |
| 3132362 | 3/1983 | Fed. Rep. of Germany . |

*Primary Examiner*—Joseph H. McGlynn

*Attorney, Agent, or Firm*—Jeffrey P. Morris

[57] ABSTRACT

A connector for a group of insulated conductors is disclosed comprising flat contact plates (14) for contacting the conductors (7) and suitable for plugging into slots (15) in the connector's casing (1), each plate provided with three contact teeth (16) which are offset laterally with regard to each other by bevelling (30) and joined together into one piece with contact strips (21) which provide contact surfaces in a plastic component for an electric plug. Narrow intermediate strips (20), provided between the contact plates and the contact strips, create heels, by means of which the contact plates rest on the plastic component. Transitional sections (25) between the contact strips and the intermediate strips create additional heels, supported within the plastic component, whereby the bent intermediate strips—carried freely through chambers—mechanically uncouple the contact plates from the contact strips.

4 Claims, 5 Drawing Figures

CONNECTOR DEVICE FOR A GROUP OF INSULATED CONDUCTORS

BACKGROUND OF THE INVENTION

1. Field of the Invention

The invention relates to the field of connectors for insulated conductors, wherein the connector has a casing of insulating material that is provided with an entrance for a cable enclosing the conductors, and is followed by several side-by-side tubular channels, with each one of the channels designed to receive one of the corresponding conductors. The casing has a series of parallel slots, each one assigned one tubular channel, connecting one outer side of the casing and the channel. The casing is also provided with contact plates, designed to be plugged from the outside, through the slots, until they come into contact with the conductors which have been inserted into their respective tubular channels. The contact plates have hooks whose edges run at right angles and [to the tubular channels] which anchor the plates to the casing.

2. Description of the Prior Art

A connecting device is known, e.g., from DE-AS No. 24 32 122 in which contact connection between the contact plates and the conductors is accomplished by bringing into elastic contact an external contact element with the back of a contact plate. Particular precautionary measures are necessary to ensure that the external contact element does not miss the relatively narrow back of the contact plate.

It is already known in the prior art from DE-OS No. 31 32 362 that a relatively wide contact strip, electrically connected to the corresponding contact plate, is required to allow comparatively easy connection between an external contact element and the contact strip, thereby establishing contact with a conductor which is coupled with the contact plate.

SUMMARY OF THE INVENTION

The object of the present invention is to obtain a connector of uncomplicated structure that allows both a reliable connection between contact plates and conductors and the joining of a contact plate and a contact strip into a one-piece plug for easy electrical coupling with external contact elements.

According to the invention, this object is performed as follows:

by providing each contact plate with three contact teeth (distributed along the assigned conductor) whose tips are offset laterally with regard to each other by simple bevelling;

by providing a plastic component (fittingly joining the casing on its slotted side) into which tongue-shaped contact strips are plugged from the side adjoining the casing, while the contact strips, lying in a plane parallel to that of the contact plates, are joined with the latter into one piece by means of an intermediate strip having a width that is less than the width of both the contact plate and the contact strip;

by providing for the contact plates to be supported at the level of the plastic component with the help of heels located between the contact plate and the intermediate strip.

As a consequence, the contact teeth biting into the conductor force it into a meandering course, so that highly pressed surfaces result between the edges of the teeth and conductor, thereby achieving a reliable contact between contact plates and conductors. The plastic component, designed to fittingly join the casing of insulating material, also provides a tool for easy plugging of the contact plates into the casing slots until the conductors are contacted.

A further embodiment of the invention is achieved by dimensioning the contact-plate heels, which point toward the plastic component, and the supporting surface of the plastic component facing the heels so as to allow a slight penetration of the heels into the mass of the plastic component. It is thus possible for the contact plates to give slightly (e.g., when they contact a solid-wire conductor), to provide the device with adaptability to various conductor types, yet ensuring a reliable contact between contact plates and conductors.

Additionally, the intermediate strips may be configured to follow a curved path, and be carried freely through chambers inside the plastic component such that, the same strips present transitionally wider sections before meeting the contact strip, thereby creating heels resting on the plastic component.

A suitable dimensioning of the curved path provides a force buffer, maintaining the contact pressure of the contact plates constant. This curved path of the intermediate strips also helps uncoupling the contact strips from the contact plates, thus preventing the unrestrained propagation to the contact plates of vibrations which act, e.g., on the contact strips. Otherwise, the efficiency of the plate-to-conductor contact would be affected.

Finally provision can also be made for the casing to present a window-type opening at the further end of the tubular channels opposite the cable entrance, exposing the tubular channels to the outside, at least on one side perpendicular to the tubular channels.

A control window is thus created, allowing easy checking of the conductors to determine if they have penetrated far enough in the tubular channels of the casing.

An embodiment of the invention is described below in greater detail with the aid of the following five figures:

DESCRIPTION OF THE PREFERRED EMBODIMENT

Figure 1:
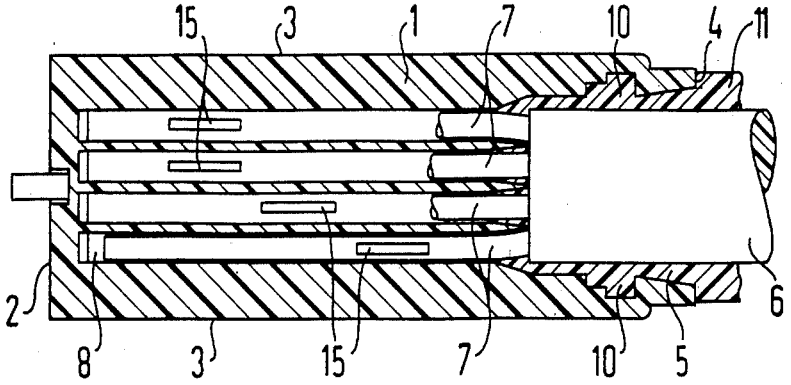
FIG. 1 is a view of the connector of the present invention from above; p
Figure 2:
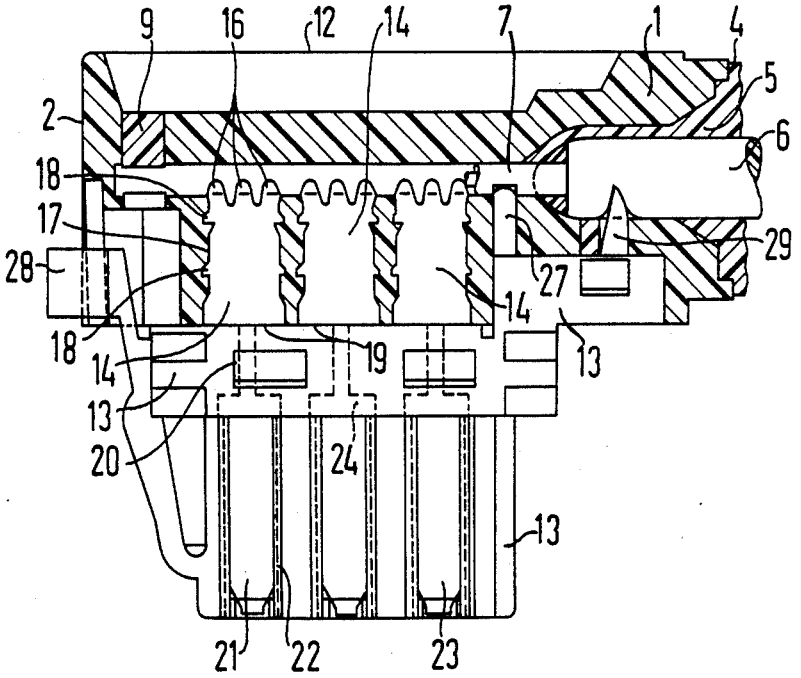
FIG. 2 is a lateral view of the connector.
Figure 3:
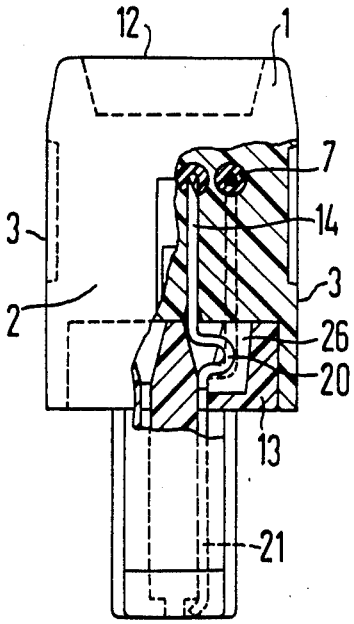
FIG. 3 and FIG. 4 are cross-sections through the connector.
Figure 4:
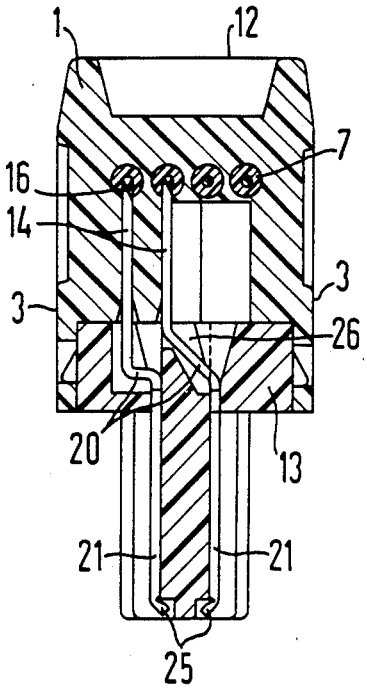

The Figures show that the device presents an elongated plastic casing 1 with a frontal side 2 and longitudinal sides 3. The reference characters throughout the Detailed Description and Figures identify like elements. On side 4, opposite side 2, the casing presents an entrance opening 5 for a cable 6. Cable 6 is the connecting conductors of a telephone set cord. In this case, four conductors 7 individually enclosed in insulating sheaths are grouped together into a sheath of insulating material.

Before introducing cable 6 into opening 5 of casing 1, the common sheath conductors 7 must be removed from the end section of cable 6 along a length corresponding to that of tubular channels 8 which are individually provided for each of the conductors 7, in continuation of entrance opening 5, into casing 1, between frontal side 2 and side 4, in a directional parallel to the longitudinal axis of the casing.

In the area of opening 5, a series of lateral grooves 10 widen entrance opening 5. In addition, entrance opening 5 is so dimensioned as to provide a clearance between the walls of casing 1 and cable 6, in the vicinity of opening 5 which may be filled with synthetic resin. Grooves 10 anchor the hardened synthetic resin mass 11, and resist possible tensions acting on cable 6, which could otherwise pull cable 6 out of casing 1.

On its upper side 12, casing 1 is closed—with the exception of window-type opening 9. Window-type opening 9 pierces through side 12 to the extremity of tubular channels 8 (containing conductors 7) opposite entrance opening 5. After conductors 7 are assembled and connected, opening 9 is also filled with resin and sealed. Through opening 9, the correct positions of conductors 7 can be checked in tubular channels 8.

On the underside (i.e., opposite upper side 12), casing 1 is provided with a suitable contour to receive insulating material component 13, designed to fit into casing 1, the insulating material being preferably plastic.

Figure 5:
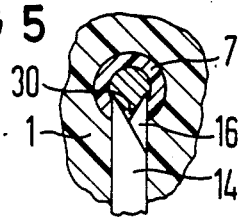
FIG. 5 shows the contacting positions of conductor and contact plate.

In the process of joining insulating material component 13 and casing 1, contact plates 14 which protrude freely out of component 13 slip through slots 15 (FIG. 1) provided in casing 1 between tubular channels 8 and the underside of casing 1 opposite upper side 12. Each one of the slots 15 is directed to one of the tubular channels 8, so that each contact plate 14 can penetrate through its assigned slot 15 until contact teeth 16 reach into tubular channel 8. Each contact plate 14 has three such contact teeth 16, distributed along the axis of its assigned tubular channel 8. Referring to FIG. 5, the free ends of contact teeth 16 are offset laterally with regard to each other by simple bevelling 30. The free ends of both outside contact teeth stand to the left of the axis of tubular channel 8 while the free end of the middle contact tooth stands to the right of the axis. Consequently, when contact teeth 16 of a contact plate penetrate conductor 7 (contained in tubular channel 8) the conductor is forced into a slightly meandering course. The reliability of conductivity between contact plate 14 and conductor 7 is thus significantly enhanced.

The contact plates are provided with hooks 18 on their edges 17, facing the narrow sides of slots 15; as the contact plates are plugged through slots 15, the hooks are pressed into the plastic of casing 1 anchoring contact plates 14 to casing 1.

The contact plates 14 rest on the upper side of plastic component 13 by means of heels 19. Moreover, heels 19 and the supporting area of the upper side of plastic component 13 are adjusted so as to allow a slight penetration of contact plates 14 into the mass of plastic component 13, if the advance of contact teeth 16 into conductor 7 meets a resistance exceeding a certain value.

Heels 19 of contact plates 14 result from the fact that contact plates 14 are connected to contact strips 21 only by means of narrow intermediate strips 20. The tongue-shaped contact strips 21 are plugged into the guide grooves 22 of plastic component 13 so that a middle zone 23 remains free on contact strips 21. Middle zones 23 of contact strips 21 are easily linked with external contact elements, e.g., with the fixed contact springs of a casing into which plastic component 13 can be plugged to a depth equal to the length of contact strips 21.

The width of contact strip 21 is designed to be narrower than that of contact plates 14. This means that contact strips 21 can be inserted into plastic component 13 from the side on which contact plates 21 are supported. The transitional section 24 located between the intermediate strips 20 and the contact strips 21, being wider than contact strips 21, but narrower than contact plates 14, provides heels resting on corresponding edges of plastic component 13, and limits the penetration of contact strips 21. The free ends 25 of contact strips 21 are bent around the edges of plastic component 13, thus anchoring contact strips 21 against displacement opposite to the direction of their initial penetration into plastic component 13.

Intermediate strips 20 follow a curved path between the transitional sections 24 and the contact plates 14, running freely through chamber 26 of plastic component 13, thus contributing to the mechanical uncoupling of contact plates 14 from contact strips 21. More specifically, no displacements of contact plates 14 occurring while the contact plates are plugged into slots 15 can affect contact strips 21, as contact plates 14 press their heels against plastic component 13.

In the process of joining plastic component 13 and casing 1, hooking teeth 29 (or respectively: blocking dowels 27), which are one-piece with plastic component 13, penetrate through suitably provided channels of casing 1 into the sheath of cable 6 (or respectively: of conductors 7) and secure these elements, previously plugged into casing 1, against their being pulled out, and relieving mechanically the contact areas of contact teeth 16 and the active cores of conductors 7.

Only after joining casing 1 and plastic component 13 is entrance opening 5 filled with synthetic resin, a process that positively attaches cable 6 to casing 1.

The body of the plastic component 13 presents a protruding, elastically springed handle 28, fitting into the corresponding contour of an outlet designed to receive the connector. The device is securely sustained in the outlet by means of handle 28.

What is claimed is:

1. A connector for a group of insulated conductors, comprised of a casing of insulating material, said casing having an entrance for a cable enclosing the conductors and including a plurality of side-by-side tubular channels, each channel for receiving one of the corresponding conductors;

said casing having a series of parallel slots, each slot aligned and assigned to one of said tubular channels, connecting one outer side of the casing and the channels; said casing also including contact plates adapted to be plugged from outside said casing, through the slots, until they contact the conductors inserted into their respective tubular channels; said plates each arranged in parallel to one of said channels; said contact plates having hooks at its edges running at right angles to the tubular channels to anchor the plates to the casing;

each contact plate having three contact teeth distributed along an edge of said plate at a channel-side of said plate whose tips are offset laterally with regard to each other by bevelling said tips such; said contact plates resting on a plastic component by means of heels between the contact plates and intermediate strips, which intermediate strips follow a curved path through a chamber of said plastic component; said plastic component fitting into said casing on its slotted side; tongue-shaped contact strips plugged into said component from the side adjoining the casing; said contact strips lying in an plane parallel to the contact plates and being joined with the contact plates into a one piece manner by means of an intermediate strip, of less width than the contact plates and the contact strips.

2. A connector according to claim 1 wherein the heels of the contact plates facing the plastic component, and the supporting surface of the plastic component facing the heels, are dimensioned so as to allow a penetration of the contact plates into the mass of the plastic component.

3. A connector according to claim 1 wherein a transitional section wider than the contact strip is provided between each contact strip and each intermediate strip creating heels by means of which the transitional section rests on the plastic component.

4. A connector according to claim 1 wherein said casing presents a window-type opening at its end, and at least on one side of the tubular channels, opposite to the cable entrance opening, permitting a passageway to the outside of the casing perpendicular to the tubular channels.

* * * * *